US007866251B2

(12) United States Patent
Nien

(10) Patent No.: US 7,866,251 B2
(45) Date of Patent: Jan. 11, 2011

(54) POWER PLANT

(76) Inventor: Yu-Hun Nien, No. 16, Meicun Rd., Puli Township, Nantou County 54546 (TW)

( * ) Notice: Subject to any disclaimer, the term of this patent is extended or adjusted under 35 U.S.C. 154(b) by 405 days.

(21) Appl. No.: 11/772,234

(22) Filed: Jul. 1, 2007

(65) Prior Publication Data

US 2009/0000293 A1 Jan. 1, 2009

(51) Int. Cl.
*F01L 25/08* (2006.01)
*F01L 15/14* (2006.01)

(52) U.S. Cl. ..... 91/248; 91/265

(58) Field of Classification Search ..... 91/248, 91/265

See application file for complete search history.

(56) References Cited

U.S. PATENT DOCUMENTS

| | | | | | |
|---|---|---|---|---|---|
| 427,809 | A | * | 5/1890 | Taylor | 91/265 |
| 457,762 | A | * | 8/1891 | Dittmar et al. | 91/275 |
| 1,445,794 | A | * | 2/1923 | Osbourn | 91/248 |
| 1,512,205 | A | * | 10/1924 | Ellis | 91/265 |
| 4,171,618 | A | * | 10/1979 | Aegerter | 91/265 |
| 4,273,028 | A | * | 6/1981 | Turnwald et al. | 91/275 |

* cited by examiner

*Primary Examiner*—F. Daniel Lopez
(74) *Attorney, Agent, or Firm*—Chun-Ming Shih

(57) ABSTRACT

A power plant produces power by using high pressure gas to push a piston. The power plant uses a supply device to provide the high pressure gas to a cylinder and controls an admission valve and an exhaust valve to admit and exhaust the high pressure gas for pushing the piston and rotating a crank member to produce power.

7 Claims, 6 Drawing Sheets

POWER PLANT

FIELD OF THE INVENTION

The present invention relates to power plants, and more particularly to a power plant by using high pressure gas to push a piston of a cylinder for producing power.

DESCRIPTION OF THE RELATED ART

Now, problems of energy sources focus on pollution produced by burning oil fuel, greenhouse effect, and exhausting in the future 30-50 years, etc. Current gas engines or engines generally use the oil fuel, such as oil or diesel oil, as the energy sources. Therefore, the oil fuel of the gas engines or engines burned will produce the pollution and produce the greenhouse effect. Furthermore, since the oil fuel is an unregenerate energy source, with the price of the oil fuel raises increasingly, global economy is impacted increasingly by the high price of the oil fuel. Therefore, an object of the present is designing a power plant producing no pollution.

The inventors of the present invention work hardly to solve the above problems. With the long work, a power plant of the present invention has been successfully designed to solve the above problems.

What is needed, therefore, is a power plant, which can solve the above problems.

BRIEF SUMMARY

The present invention is providing a power plant, which produces power by using high pressure gas to push a piston. The power plant does not exhaust pollution and produce greenhouse effect.

A power plant in accordance with a preferred embodiment of the present invention includes a cylinder and an outer supply device for providing high pressure gas. The outer supply device provides the high pressure gas to the cylinder for pushing a piston and rotating a crank member to produce power.

Compared with the conventional power plants, the present power plant uses the high pressure gas to press the piston and drive the crank member. Therefore, the present power plant has a simple structure better than the conventional power plants using the oil fuel. Furthermore, the gas can be easily obtained and cheap, and has no pollution and no greenhouse effect. The present power plant operates without burning the oil fuel, and operates safely and quietly, and is worth to be used widely.

Other objects, advantages and novel features of the invention will become more apparent from the following detailed description when taken in conjunction with the accompanying drawings, in which:

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
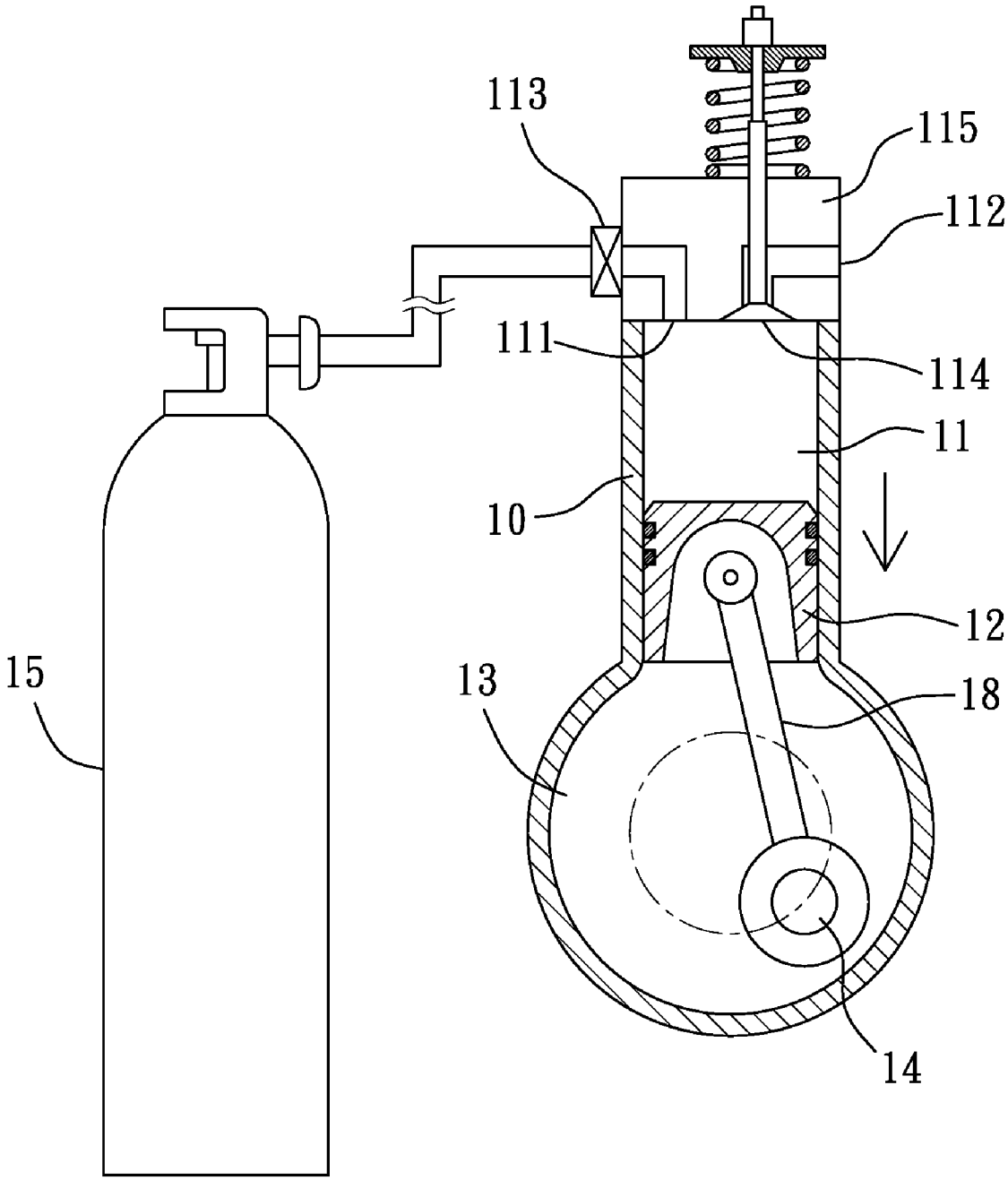
FIG. 1 is a schematic, cross-sectional view of a power plant in a first condition in accordance with a first preferred embodiment of the present invention, wherein the admission valve being opened and the exhaust valve being closed.

Reference will now be made to the drawings to describe a preferred embodiment of the present power plant, in detail.

The design of the present invention is guiding high pressure gas into a cylinder having a piston and exhausting the high pressure gas out by controlling an admission valve and an exhaust valve to push the piston upwards or downwards and drive a crank member rotating for producing power.

Referring to FIGS. 1-5, a power plant in accordance with a preferred embodiment of the present invention is shown. The power plant includes a cylinder body 10 and a supply device 15 for providing high pressure gas. The cylinder body 10 includes a cylinder 11, a piston 12, a crank chamber 13 and a crank member 14. The cylinder 11 has an admission passage 111 and an exhaust passage 112. An admission valve 113 is arranged in the admission passage 111, and an exhaust valve 114 is arranged in the exhaust passage 112. The piston 12 is arranged in the cylinder 11 and moveable therein. The crank chamber 13 is assembled on the cylinder 11 and communicated with the cylinder 11. The crank member 14 is arranged in the crank chamber 13 and connected with the piston 12 by performable methods. For example, the crank member 14 is connected with the piston 12 through a pole 18, which is used as a connecting member. Furthermore, the crank member 14 has an axis 141 for serving as an output terminal.

The supply device 15 for providing the high pressure gas, is arranged adjacent to the cylinder 11, and communicated with the admission passage 111 of the cylinder 11 for providing the high pressure gas in the cylinder 11. In this exemplary embodiment, the supply device 15 is a high pressure bottle for schlepping and moving conveniently and being adapted to be amounted on power vehicles or motorcycles. Furthermore, the gas in the supply device 15 can be selected from safe and environmental protection gas. For example, the gas in the supply device 15 can be air, which is cheap and safe, is obtained easily and has no any pollution.

Figure 2:
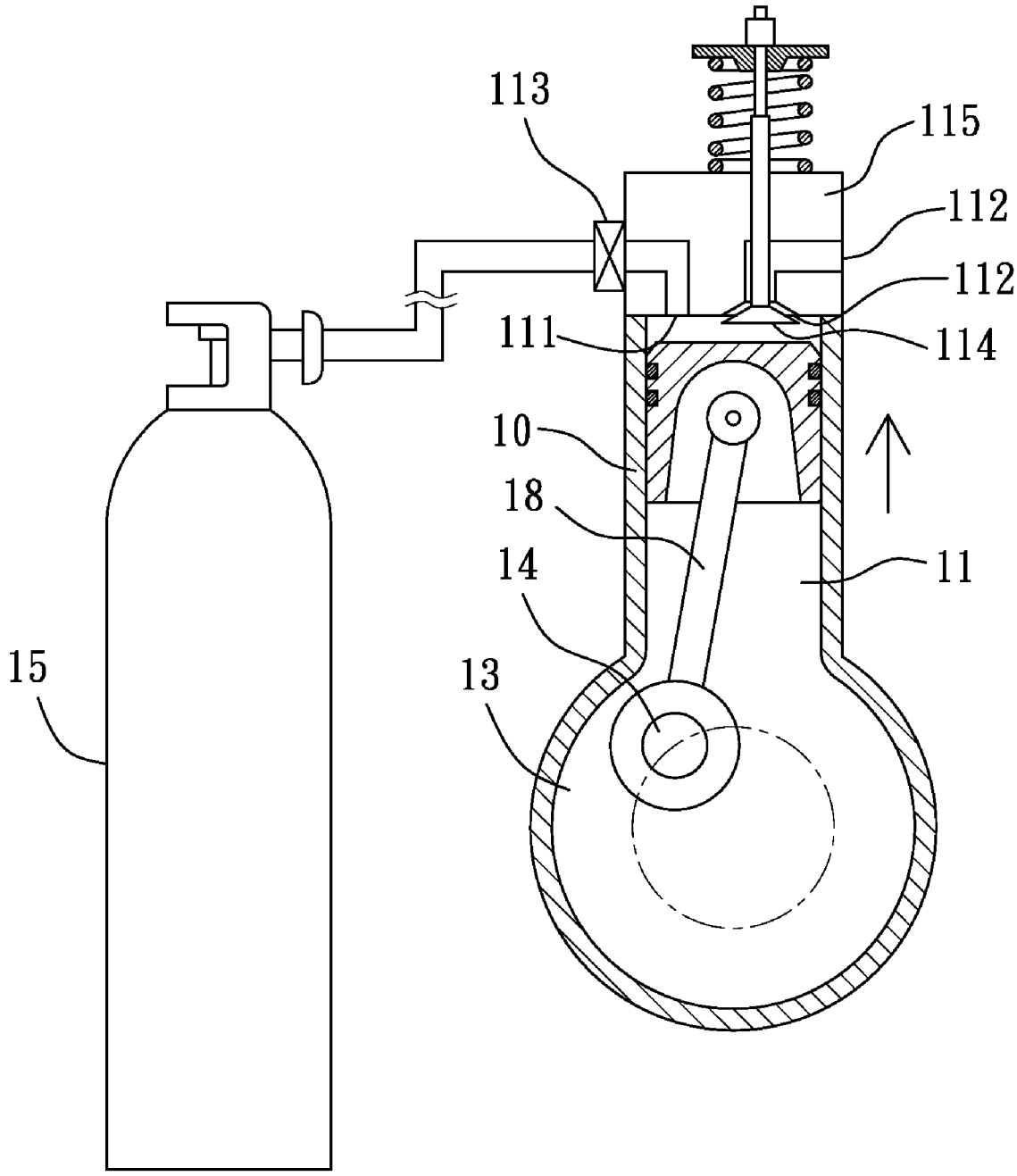
FIG. 2 is a schematic, cross-sectional view of a power plant in a second condition in accordance with a second preferred embodiment, wherein the admission valve being closed and the exhaust valve being opened.
Figure 3:
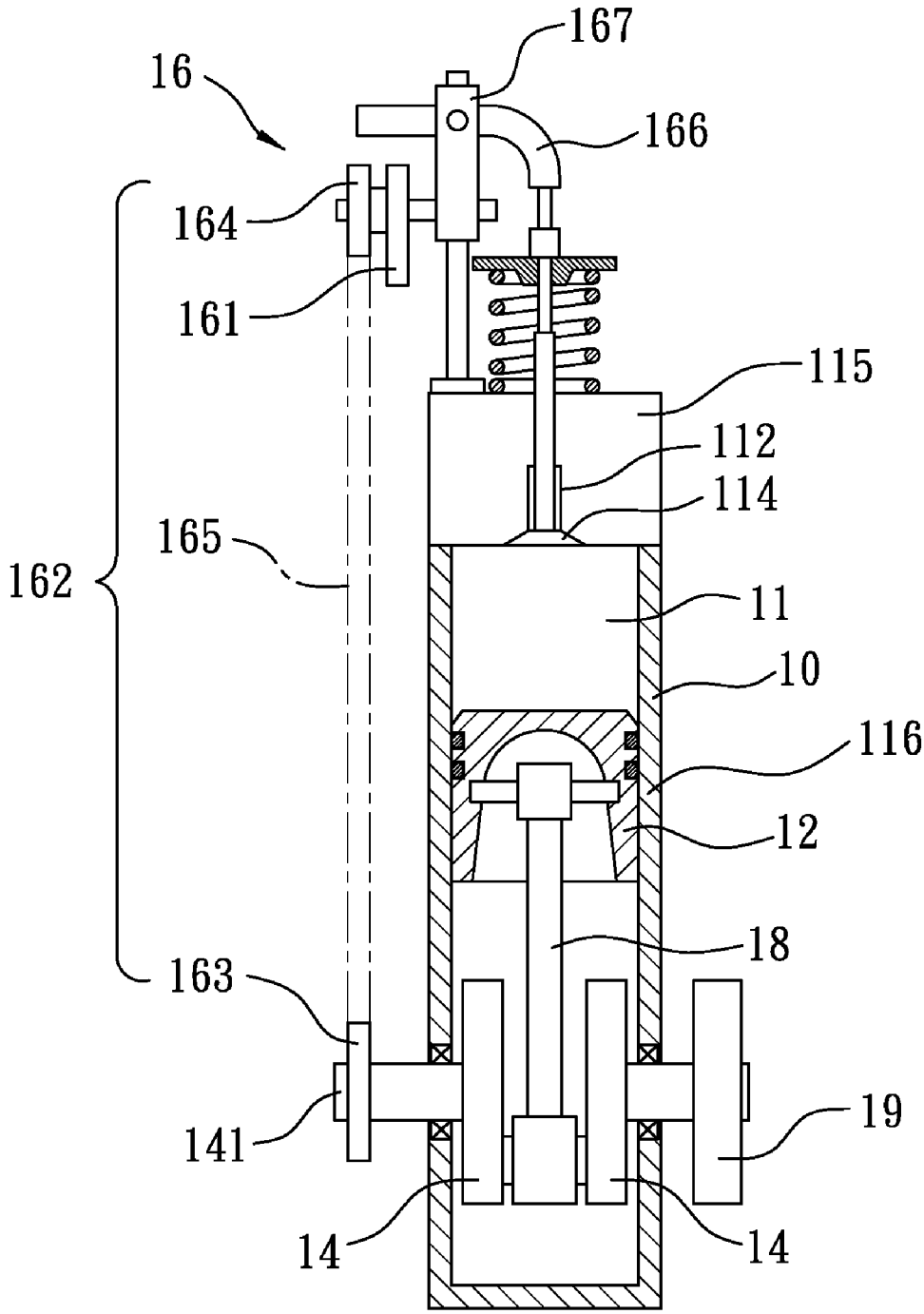
FIG. 3 is a schematic, side cross-sectional view of the power plant in accordance with the second preferred embodiment, wherein the cylinder body including a single cylinder and the valve being a poppet valve of mechanical valves.
Figure 4:
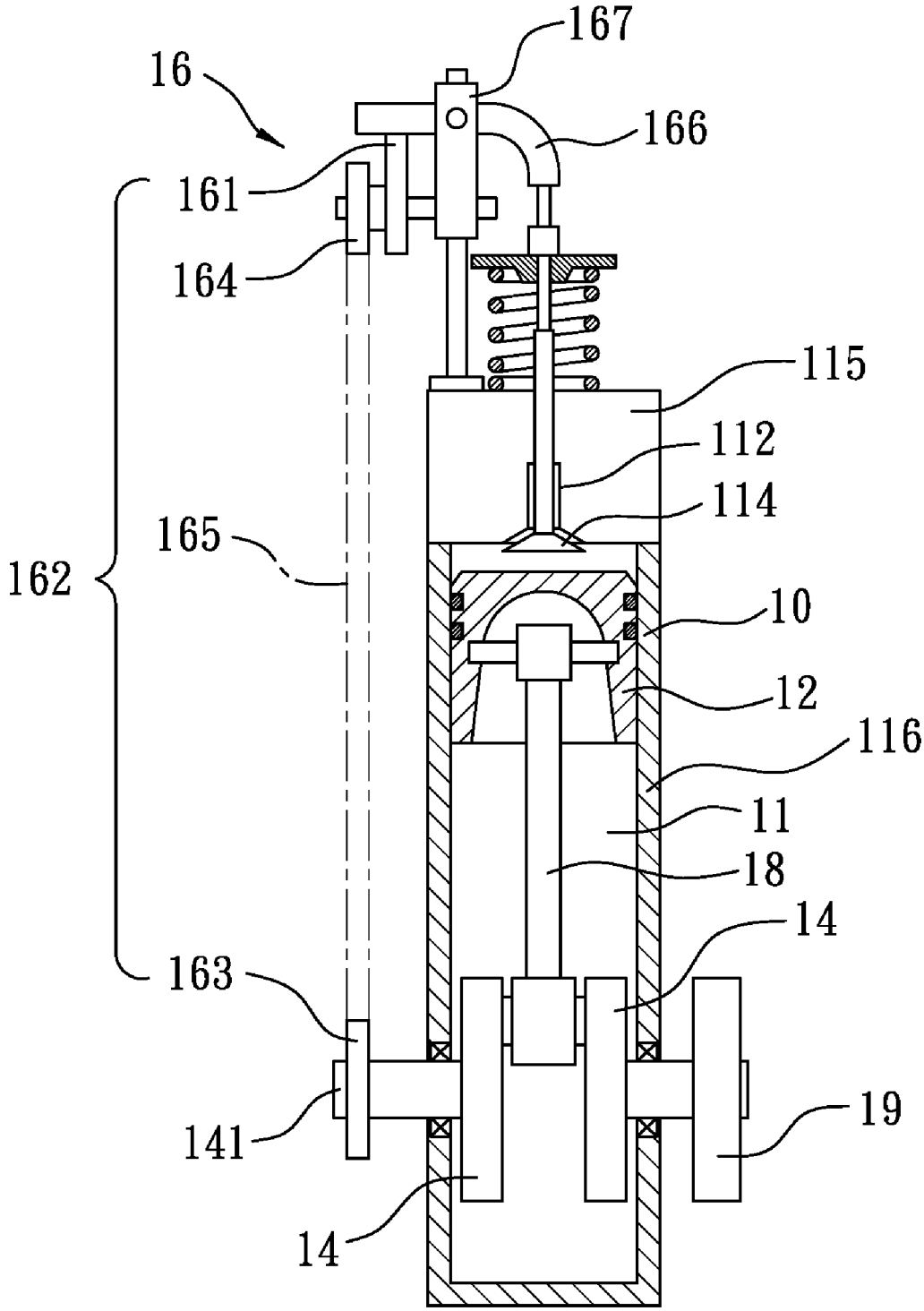
FIG. 4 is a schematic, side cross-sectional view of the power plant in a second condition in accordance with the first preferred embodiment, wherein the cylinder body including a single cylinder and the valve being a poppet valve of mechanical valves.
Figure 5:
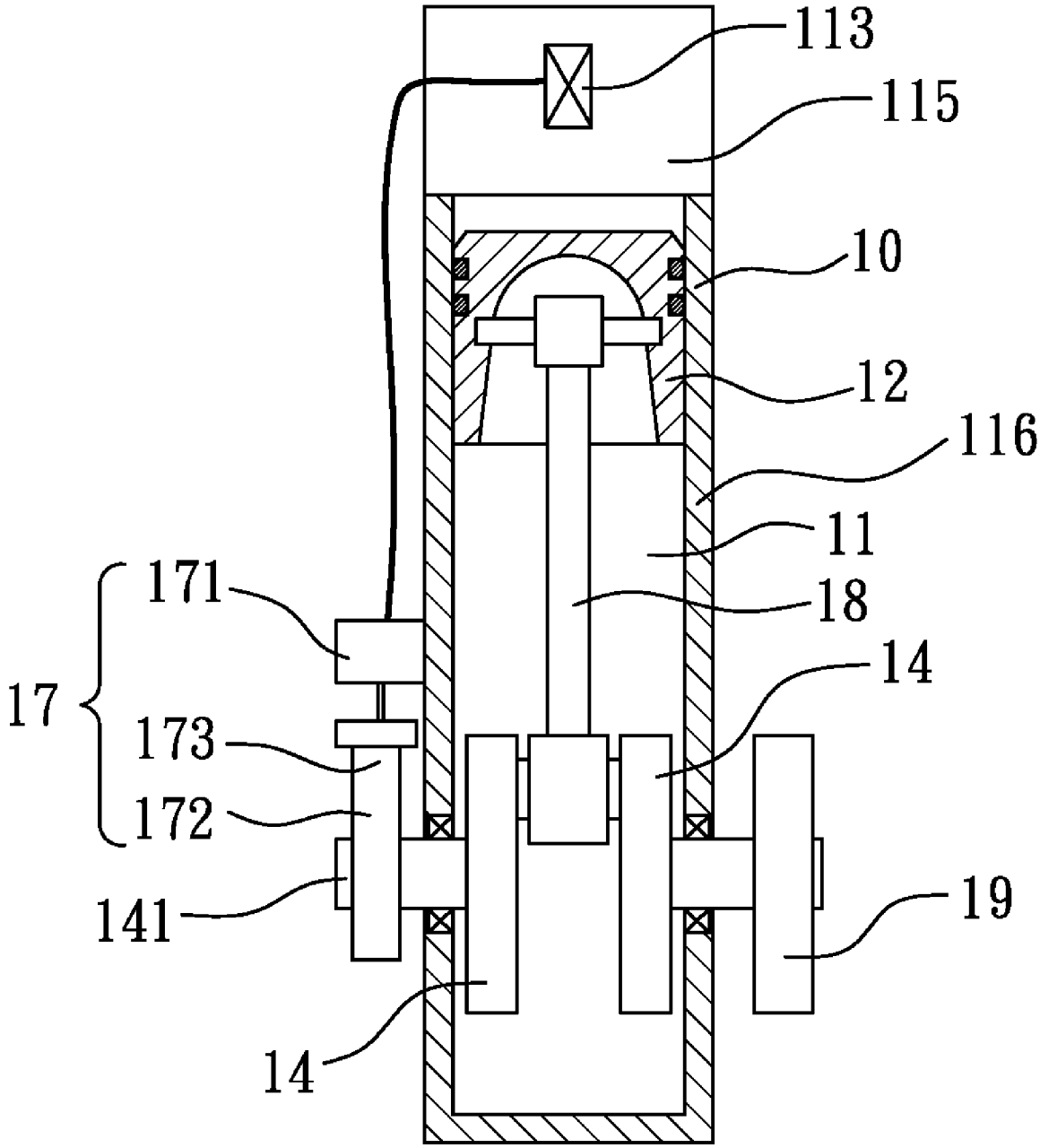
FIG. 5 is another schematic, side cross-sectional view of the power plant in accordance with the second preferred embodiment, wherein the cylinder body including a single cylinder and the valve being a solenoid valve.

The admission valve 113 and the exhaust valve 114 can be selected from two different mode valves consisting of mechanical valves and electronic valves. For example, the exhaust valve 114 as shown in FIGS. 1-4 is a poppet valve, which is a normal mechanical valve, and the admission valve 113 as shown is FIGS. 1, 2 and 5 is a typical solenoid valve. However, the admission valve 113 and the exhaust valve 114 as shown in FIGS. 1-5 is only used to explain the present invention. Both of the admission valve 113 and the exhaust valve 114 can be selected from the two different mode valves.

In the embodiment as shown in FIGS. 1-4, the exhaust valve 114 is the poppet valve, and is controlled by a valve driving member 16. The valve driving member 16 includes a cam follower 161. The cam follower 161 is connected with the axis 141 of the crank member 14 through a transmission group 162. The transmission group 162 includes a first gear 163, a second gear 164, and a chain 165 connected and engaged with the first gear 163 and the second gear 164. The cam follower 161 of the valve driving member 16 rotates by rotating the output terminal of the crank member 14 to control the exhaust valve 114 (the poppet valve).

Furthermore, the valve driving member 16 further includes an extending arm 166. The cam follower 161 can touch the popper valve 114 through the extending arm 166. The extending arm 166 may be arranged rotatably and coaxially on a pivot seat 167, and the pivot seat 167 is fixed on a head portion 115 of the cylinder 11.

In the embodiment as shown in FIGS. 1, 2 and 5, the admission valve 113 is the solenoid valve, which is driven by a valve driving member 17. The valve driving member 17 includes a limit switch 171 and a cam 172 for driving the limit switch 171. The limit switch 171 is electrically connected with the solenoid valve (the admission valve 113). The cam 172 is connected with the output terminal of the crank member 14 and rotates by rotating the output terminal of the crank member 14 to drive the limit switch 171 and control the solenoid valve (the admission valve 113).

Furthermore, a flywheel 19 is arranged at a side of the crank member 14.

The operation of the power plant of the present invention is described as following:

When the piston 12 moves between an upper dead center and 10 degrees before the upper dead center, the admission valve 113 is opened to provide the high pressure gas into the cylinder 11. At the same time, the exhaust valve 114 is closed. Therefore, at this time, a protrusion 173 of the cam 172 touches the limit switch 171 to open the admission valve 113.

When the piston 12 moves between approximate 10 degrees before a lower dead center and the lower dead center, the admission valve 113 is closed to stop providing the high pressure gas. Tests prove the power plant outputs excellently power by closing the admission valve 113 at the 10 degrees before the lower dead center.

When the piston 12 reaches the lower dead center, the exhaust valve 114 is opened to exhaust the high pressure gas out.

When the piston 12 reaches 5 degrees before the upper dead center, the exhaust valve 114 is closed. Tests prove it is perfect by closing the exhaust valve 114 at the 10 degrees before the upper dead center.

When the piston 12 reaches the upper dead center, the above steps repeat.

In the operation described as the above, since the cylinder 11 has stopped to providing the high pressure gas and the high pressure gas has been exhausted when the piston 12 returns the upper dead center from the lower dead center, the piston 12 can return the upper dead center by inertial power of the crank member 14 and the flywheel 19.

Figure 6:
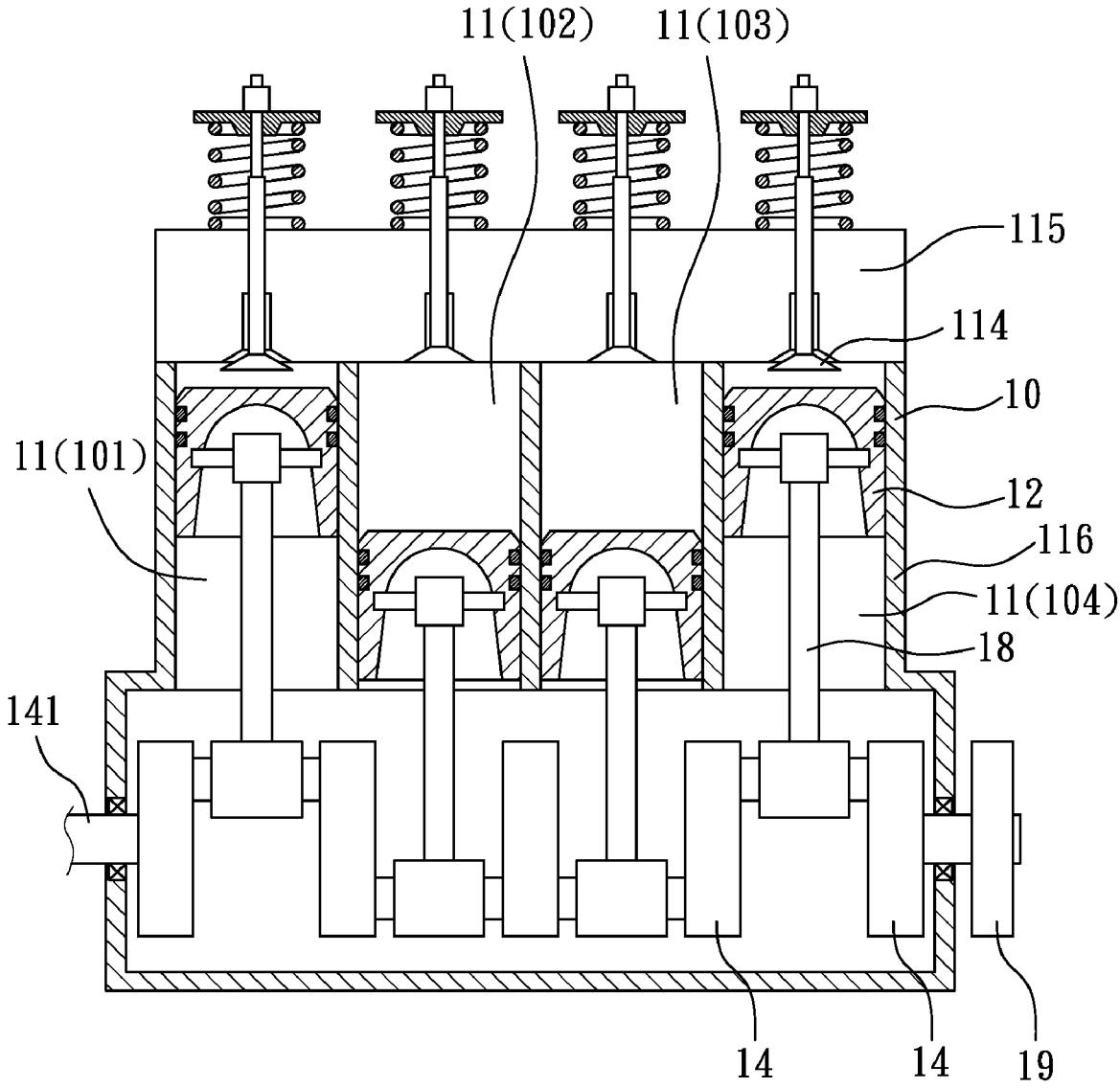
FIG. 6 is a schematic, cross-sectional view of a power plant in accordance of the second preferred embodiment, wherein the cylinder body including four cylinders arranged in line.

The embodiment as shown in FIGS. 1-5 discloses a power plant having a single cylinder. FIG. 6 discloses an embodiment having a plurality of cylinders. The plurality of cylinders are arranged in line in FIG. 6. However, the plurality of cylinders can be also arranged in parallel, or in V-shape (not shown), etc.

In the embodiment having four cylinders as shown in FIG. 6, a first cylinder 101 and a fourth cylinder 104, and a second cylinder 102 and a third cylinder 104 respectively admit and exhaust the high pressure gas synchronously for achieving perfect balance and power.

The embodiments of the present invention employ the high pressure gas to provide high pressure power to the cylinder, and use the admission valve and the exhaust valve to admit and exhaust the high pressure gas to push the piston upwards or downwards and rotate the crank member to produce the power. Therefore, the present invention will not produce greenhouse gas exhausting, have no pollution and be clean. The gas can be obtained conveniently and be cheap. Furthermore, the power plant itself does not produce a superheating problem, and has a simple structure, and decrease the cost.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A power machine, comprising:

a cylinder body having at least one cylinder, the at least one cylinder having at least one admission passage and at least one exhaust passage arranged on a head portion thereof, an electronic valve arranged in the at least one admission passage serving as an admission valve, and an exhaust valve arranged in the at least exhaust passage;

at least one piston moveably arranged in the at least one cylinder;

a crank chamber mounted on the at least one cylinder;

a crank member arranged in the crank chamber and connected with the piston; and an outer supply device communicated with the admission passage of the cylinder to provide high pressure gas;

wherein the electronic valve is a solenoid valve driven by an admission valve driving member, the admission valve driving member comprises a limit switch and a cam for driving the limit switch, the limit switch is electrically connected with the solenoid valve, and the cam is connected with an output terminal of the crank member to drive the cam by driving the output terminal of the crank member for driving the limit switch and controlling the solenoid valve;

wherein the exhaust valve is a poppet valve controlled by an exhaust valve driving member, the exhaust valve driving member comprises a cam follower and a transmission group, the cam follower is connected with an output terminal of the crank member through the transmission group to drive the cam follower by driving the output terminal of the crank member for controlling the poppet valve, and wherein the exhaust valve driving member further comprises an extending arm, the cam follower touches the poppet valve through the extending arm, the extending arm is arranged rotatably and coaxially on a pivot seat, and the pivot seat is fixed on the head portion of the cylinder;

wherein the high pressure gas is admitted into and exhausted out of the cylinder by controlling the electronic valve and the exhaust valve to push the piston upwards or downwards and rotate the crank member for producing power; and wherein when the piston reaches an upper dead center, the electronic valve is opened and the exhaust valve is closed; when the piston reaches approximate 10 degrees before a lower dead center, the electronic valve is closed to stop providing the high pressure gas; when the piston reaches the lower dead center, the exhaust valve is opened to exhaust the high pressure gas; when the piston reaches approximate 5 to 10 degrees before the upper dead center, the exhaust valve is closed; when the piston returns to the upper dead center, the above steps repeats to maintain the piston moving circularly and maintain the crank member rotating for producing the power.

2. The power machine as claimed in claim 1, further comprising a pole arranged between the piston and the crank member.

3. The power machine as claimed in claim 1, further comprising a flywheel connected with the crank member.

4. The power machine as claimed in claim 1, wherein the cylinder body comprises a single cylinder or a plurality of cylinders.

5. The power machine as claimed in claim 1, wherein when the piston reaches 10 degrees before the upper dead center, the exhaust valve is closed.

6. The power machine as claimed in claim 1, wherein the cylinder body has four cylinders, a first cylinder and a fourth cylinder admit and exhaust the high pressure gas synchronously, and a second cylinder and a third cylinder admit and exhaust the high pressure gas synchronously.

7. The power machine as claimed in claim 1, wherein the electronic valve is driven, so that the high pressure gas is provided between 0 to 169 degrees, and the poppet valve is driven, so that the high pressure gas is exhausted between 180 and 349-354 degrees.

* * * * *